US011447940B2

(12) United States Patent
Fazio

(10) Patent No.: US 11,447,940 B2
(45) Date of Patent: Sep. 20, 2022

(54) SELF-SUPPORTING BATHTUB SPOUT EXTENSION SYSTEM

(71) Applicant: Testarossa Incorporated, Homer Glen, IL (US)

(72) Inventor: Stefano C. Fazio, Lemont, IL (US)

(73) Assignee: Testarossa Incorporated, Homer Glen, IL (US)

( * ) Notice: Subject to any disclaimer, the term of this patent is extended or adjusted under 35 U.S.C. 154(b) by 212 days.

(21) Appl. No.: 16/890,790

(22) Filed: Jun. 2, 2020

(65) Prior Publication Data

US 2021/0372101 A1 Dec. 2, 2021

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415
USPC ..... 4/678
See application file for complete search history.

(56) References Cited

U.S. PATENT DOCUMENTS 1,354,838 A 10/1920 Perkins
1,714,694 A 10/1926 Riley
2,171,023 A 12/1938 Buxton
D282,563 S * 2/1986 Beene ..... D21/616
4,951,329 A 8/1990 Shaw
D326,312 S * 5/1992 Frankel ..... D23/256
5,125,577 A * 6/1992 Frankel ..... E03C 1/046 239/289
5,337,956 A 8/1994 Crutcher
6,164,570 A 12/2000 Smeltzer
6,381,770 B1 5/2002 Raisch
D465,009 S * 10/2002 Siefken ..... A47K 3/005 D21/616
6,782,567 B1 8/2004 Austin
D612,492 S * 3/2010 Krumins ..... D21/616
8,276,615 B2 10/2012 Weber
D691,699 S * 10/2013 Berger ..... D23/213
2007/0130688 A1* 6/2007 Thorne ..... G01K 1/143 374/E1.019
2007/0175531 A1 8/2007 Daniels
2007/0277891 A1 12/2007 Frankel
2011/0023979 A1* 2/2011 Henderson ..... A47K 3/005 29/428

(Continued)

*Primary Examiner* — Huyen D Le
(74) *Attorney, Agent, or Firm* — Scott R. Kaspar; Kaspar Law Company, LLC

(57) ABSTRACT

A system for distributing water from a bathtub spout protruding from a wall into a bathtub residing below the spout is disclosed. The system includes a wall plate mounted to the wall and surrounding but not contacting the spout, the wall plate having a bracket portion extending away from the wall, the bracket portion enclosing but not contacting the spout. The system further includes a water diverting portion configured to fit over and attach to the bracket portion of the wall plate, the water diverting portion configured to receive water flowing out of the spout and to divert the water to an outlet. The system further includes at least one tubular member fluidly connected to the outlet of the water diverting portion, the at least one tubular member terminating in an outlet having a plurality of holes to create a spray pattern from the water flowing out of the spout.

10 Claims, 7 Drawing Sheets

(56) References Cited

U.S. PATENT DOCUMENTS

| | | | |
|---|---|---|---|
| 2013/0326804 | A1 | 12/2013 | Autry |
| 2018/0127958 | A1 | 5/2018 | Zhong |

* cited by examiner

SELF-SUPPORTING BATHTUB SPOUT EXTENSION SYSTEM

TECHNICAL FIELD

The present invention relates to bathtub spouts, and more particularly, to a self-supporting system for extending a bathtub spout to provide fluid delivery in a plurality of locations and/or spray patterns.

BACKGROUND

It is not uncommon for some small children to have a fear of taking showers, as opposed to a bath. Spray patterns from showers often trigger unique sensory reactions that for some small children may create anxiety or otherwise turn the routine function of bathing into an unpleasant experience. Children with these sensory issues often have to fight through several episodes of showering to overcome this anxiety or build up a tolerance to showering.

There exists in the relevant art a number of devices that secure to a bathtub spout for improving the bathing experience for small children. Many of these devices are intended to be used as safety devices to prevent a child from striking his or her head on the bathtub spout, which otherwise can cut a child's head upon impact. For example, the Nûby™ brand "Hippo Spout Guard," shown online at https://www.nuby-.com/usa/en/hippo-spout-guard, is a resilient device that slips over and secures to a bathtub spout to provide a layer of protection for children. Even still, this device does not otherwise transform the bathtub experience for children.

There also exists a number of prior art devices that effectively replace the bathtub spout with a handheld showering head. For example, U.S. Patent Application Publication No. 2018/0129758 to Zhong discloses a handheld showering wand that can be connected to bathtub plumbing in place of a bathtub spout.

There are no known devices in the relevant art for helping children to overcome showering anxiety, or to assist children in transitioning from the bathtub experience to a showering experience.

SUMMARY OF THE INVENTION

According to one non-limiting aspect of the present disclosure, a system for distributing water from a bathtub spout protruding from a wall into a bathtub residing below the spout is disclosed. The system includes a wall plate mounted to the wall and surrounding but not contacting the bathtub spout, the wall plate having a bracket portion extending from the wall plate and away from the wall, the bracket portion enclosing but not contacting the bathtub spout. The system further includes a water diverting portion configured to fit over and attach to the bracket portion of the wall plate, the water diverting portion configured to receive water flowing out of the bathtub spout and to divert the water to an outlet. The system further includes at least one tubular member fluidly connected to the outlet of the water diverting portion, the at least one tubular member terminating in an outlet having a plurality of holes to create a spray pattern from the water flowing out of the bathtub spout.

According to another non-limiting aspect of the present disclosure, an example embodiment of a system for distributing water from a bathtub spout protruding from a wall into a bathtub residing below the spout is disclosed. The system includes a wall plate mounted to the wall and surrounding but not contacting the bathtub spout, the wall plate having a bracket portion extending from the wall plate and away from the wall, the bracket portion enclosing but not contacting the bathtub spout. The system further includes a water diverting portion configured to fit over and attach to the bracket portion of the wall plate, the water diverting portion configured to receive water flowing out of the bathtub spout and to divert the water to an outlet, wherein the water diverting portion further including an inlet for receiving a small ball, the ball traveling within and through the water diverting portion and emitting from the outlet of the water diverting portion. The system further includes at least one tubular member fluidly connected to the outlet of the water diverting portion, the ball traveling within and through the at least one tubular member.

Additional features and advantages are described herein, and will be apparent from the following Detailed Description and the figures.

BRIEF DESCRIPTION OF THE DRAWINGS

Features and advantages of the system and method described herein may be better understood by reference to the accompanying drawings in which.

A skilled artisan will appreciate the foregoing details, as well as others, upon considering the following Detailed Description of certain non-limiting embodiments of the bathtub spout extension system according to the present disclosure. One of ordinary skill also may comprehend certain of such additional details upon using the system described herein.

DETAILED DESCRIPTION

The present disclosure, in part, is directed to bathtub spouts, and more particularly, to a self-supporting system for extending a bathtub spout to provide fluid delivery in a plurality of locations and spray patterns.

Figure 1:
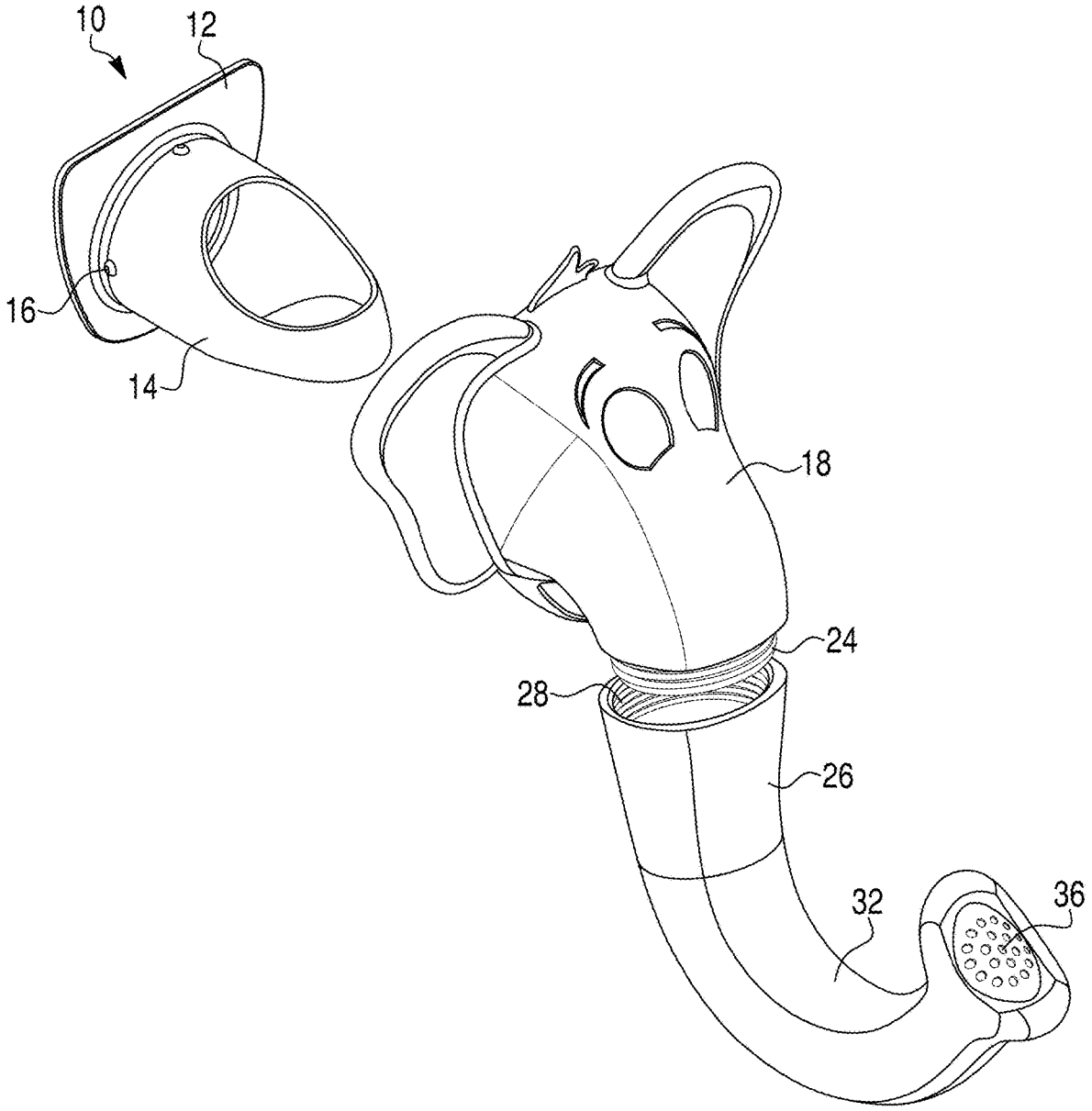
FIG. 1 depicts a perspective view of an embodiment of a bathtub spout extension system of the present disclosure.

As shown in FIG. 1, a self-supporting bathtub spout extension system 10 is disclosed, the system having a wall plate 12 that mounts to the backsplash or wall from which a bathtub spout protrudes. The wall plate 12 mounts directly to the wall using fasteners such as adhesive tape, suction cups, adhesive, or caulk, such that the wall plate 12 may be removed from the wall without creating any damage to the wall. It is important to note that the wall plate 12 surrounds but does not contact the bathtub spout and is not connected or attached to the bathtub spout. Wall plate 12 includes a protruding bracket portion 14 that surrounds or envelopes the bathtub spout but does not contact the bathtub spout in any manner. The bracket portion 14 is attached only to the wall plate 12 and is configured to support a bathtub extension system as described herein. The bracket portion 14 further includes a plurality of small protrusions or buttons 16 extending from and circumnavigating the bracket portion 14 at a location proximate the wall plate 12. Preferably, three or more protrusions 16 are used to receive and secure a head portion 18 of the bathtub spout extension system 10. Wall plate 12, bracket portion 14, and protrusions 16 may be separate components interconnected with or attached to one another, or the componets may be of a unibody construction, as those skilled in the art would appreciate could be created by injection molding of plastic or similar composite materials.

Head portion 18 is configured to fit over bracket portion 14 and to secure to bracket portion by interlocking or engaging with protrusions 16. Head portion 18 is configured to divert or direct water from the bathtub spout through the interior of the head 18 and out a threaded outlet 24. Head portion 18 is intended to be whimsical in nature, such as the elephant-like shape depicted in FIG. 1. The exterior shape of head portion 18 is ornamental in nature and could be fashioned to resemble any number of other animals or characters.

Connecting to threaded outlet 24 is a plurality of tube-like components that distribute water from the bathtub spout to other locations inside the bathtub. For instance, a middle section 26, here resembling an elephant's trunk, may bring the water downwardly into the bathtub, with an end section 32 which then brings the water up towards a child or person sitting inside the bathtub. Middle and end sections 26, 32 threadably connect to one another and may be interchanged, or middle section 26 may be removed altogether, to create a different effect. End section 32 includes an outlet 36 containing a plurality of holes to create a shower or similar spray pattern.

Figure 2:
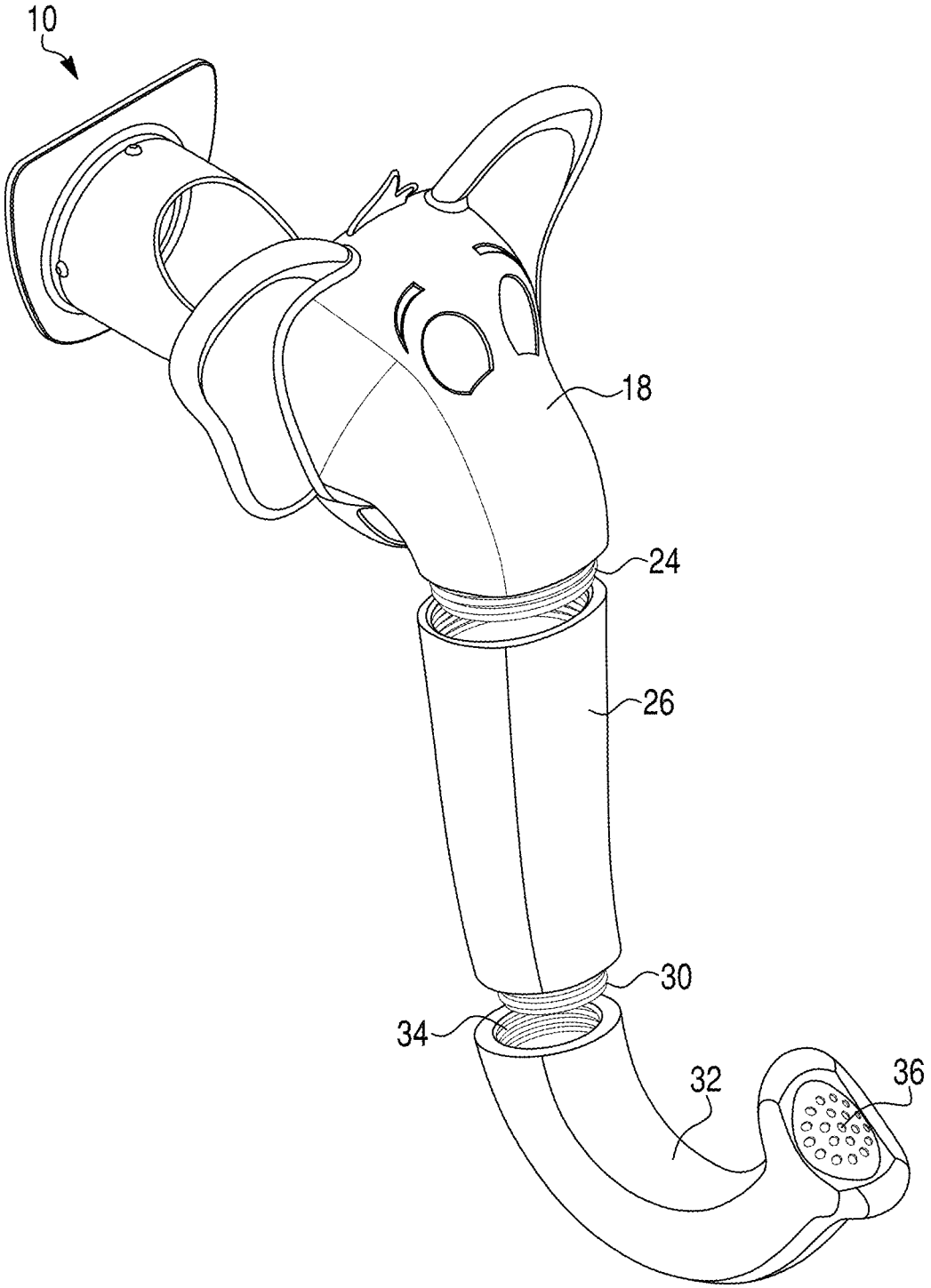
FIG. 2 depicts a perspective view of another embodiment of a bathtub spout extension system of the present disclosure.

As shown in FIG. 2, middle section 26 may be lengthened or further extended downwardly into the bathtub, as necessary to accommodate different depth bathtubs or to bring water from the bathtub spout to other locations in the bathtub. For instance, middle section 26 may be flexible such that it can be bent to move side-to-side or to come outwardly towards the center of the bathtub. Middle section 26 and end section 32 are attached via threaded surfaces 30, 34, such that end section 32 may rotate within the bathtub about middle section 26.

Figure 3B:
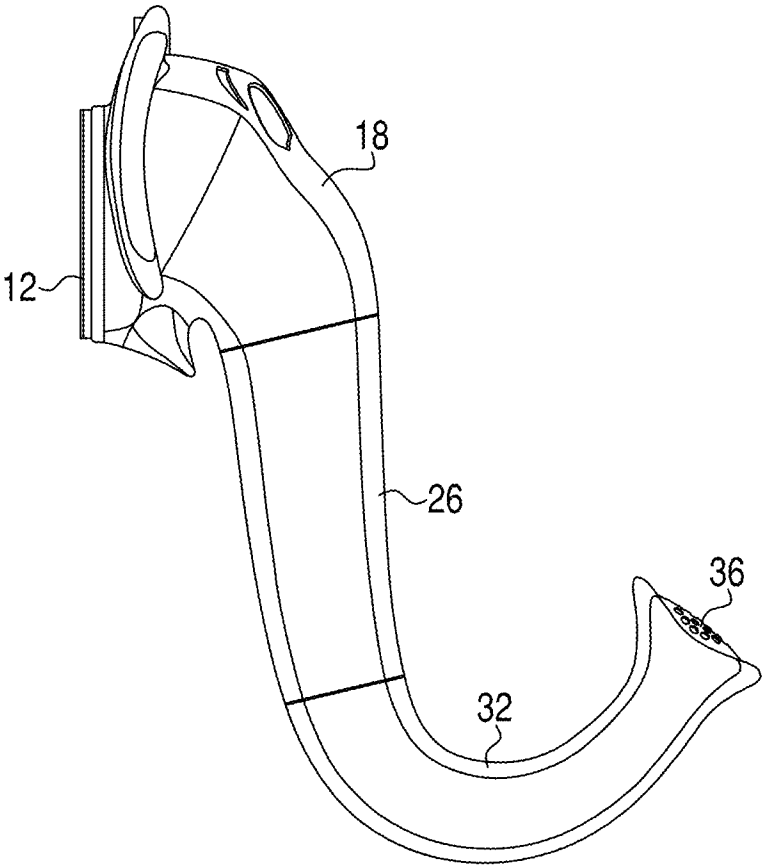
FIG. 3B depicts a side view of the bathtub spout extension system of FIG. 2.
Figure 3A:
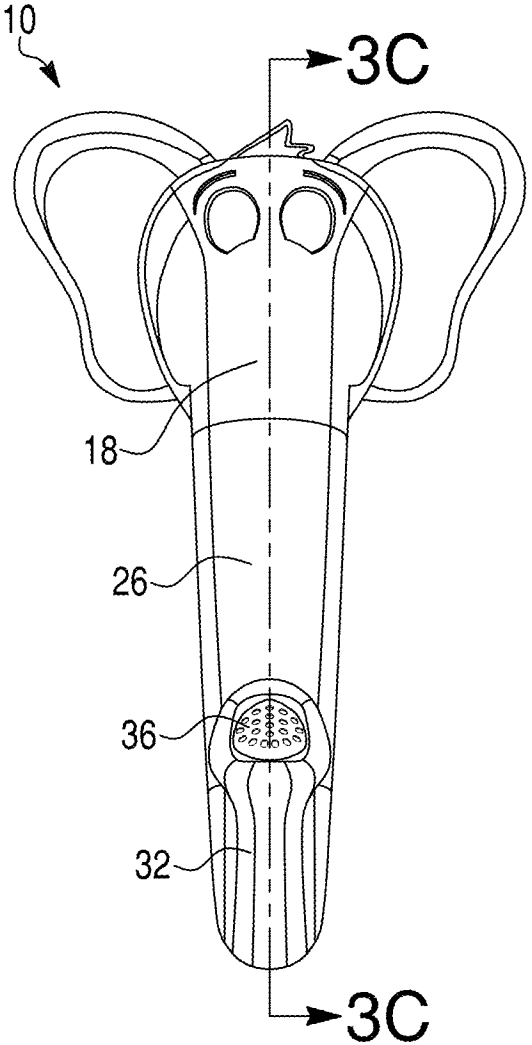
FIG. 3A depicts a front view of the bathtub spout extension system of FIG. 2.

As shown in FIGS. 3A and 3B, the head portion 18, middle section 26, and end section 32 are tubular in nature and hollow so as to distribute water from the bathtub spout through the head 18 and sections 26, 32, and out of outlet 36, thereby creating a shower-like spray pattern emitting from outlet 36 and into the bathtub. This may be desirable for a small child or for an individual who is unable to stand in a conventional shower.

Figure 3C:
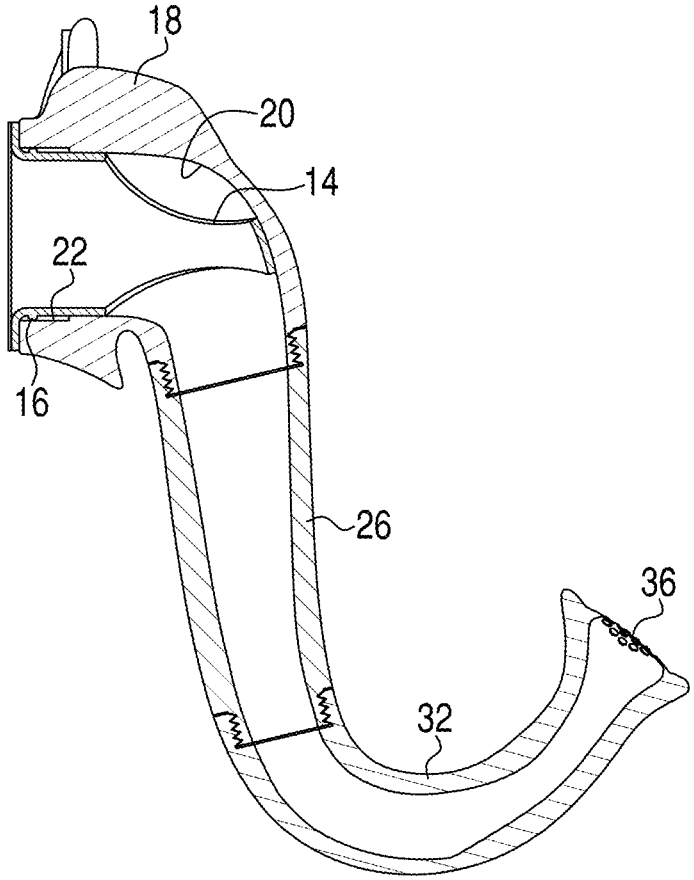
FIG. 3C depicts a sectional side view of the bathtub spout extension system of FIG. 2.

As shown in FIG. 3C, the head portion 18 has an interior cavity 20 that is configured to receive bracket portion 14 to support and hold the head 18 in line with the bathtub spout. The interior cavity 20 has a recessed portion or groove 22 that is configured to receive and mate with the protrusions 16 to secure the head portion 18 to the bracket portion 14. In this arrangement, the head portion 18 is mounted against the wall plate 12, but is removable from the wall plate 12 and bracket portion 14 if sufficient force is placed onto the head portion 18.

Figure 4:
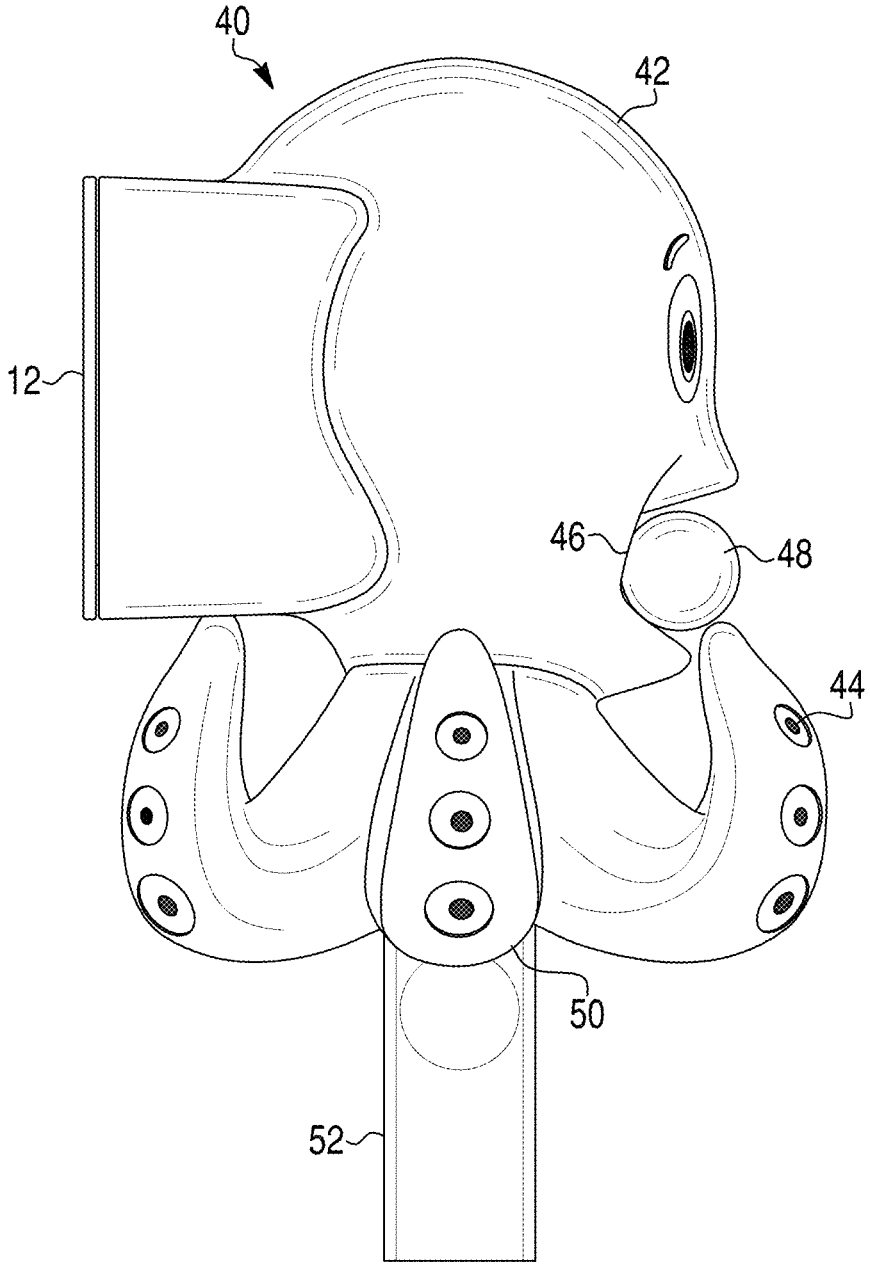
FIG. 4 depicts a side view of another embodiment of a bathtub spout extension system of the present disclosure.
Figure 5:
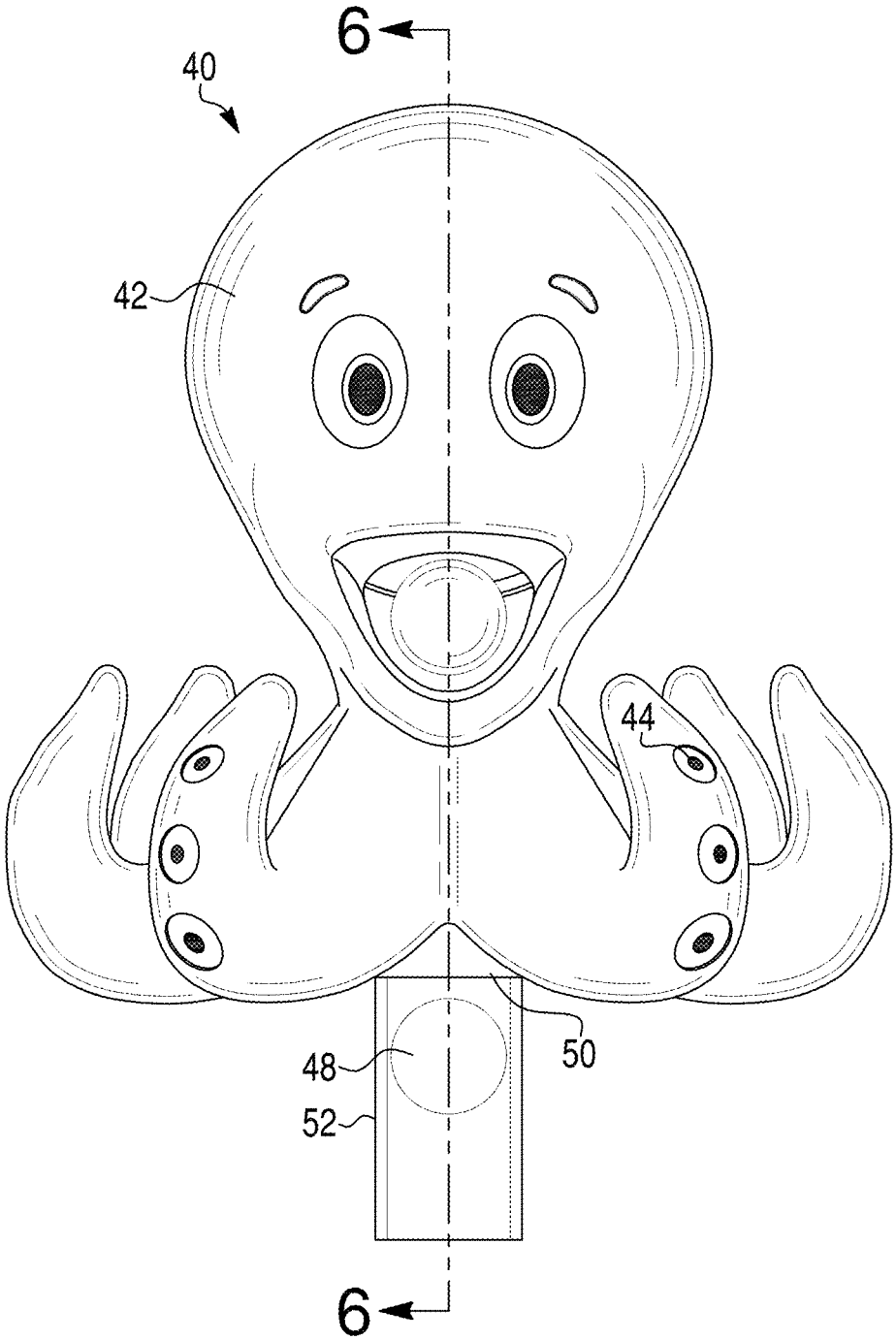
FIG. 5 depicts a front view of the bathtub spout extension system of FIG. 4.

As shown in FIGS. 4-5, other animal or characters may be fashioned to attached to wall plate 12 and provide a similar effect of distributing water from the bathtub spout to other locations within the bathtub. As shown in FIG. 4, an octopus-like animal 40 is disclosed having a head portion 42 that fits over bracket portion 14 to secure the head 42 to the wall plate 12, in a similar manner by a compression fit between protrusions 16 and interior surfaces of the head 42. The head portion 42 includes a plurality of outlets 44 for distributing water from the bathtub spout through the head portion 42 and out the outlets 44, creating a shower-like spray pattern out of a portion of the head portion 42, here fashioned as the tentacles of an octopus.

Head portion 42 also includes an inlet 46, fashioned as the octopus' mouth, configured to receive a small ball 48, such as a ping pong ball. The ball enters an interior portion of the head 42 where it encounters water flowing out of the bathtub spout within the head portion 42. The force of the water pressure pushes the ball 48 downwardly through the head portion 42 and out an outlet 50. A tube 52 connected with outlet 50 and protruding downwardly from the head portion 42 carries the ball 48 and some of the flow of water from the bathtub spout to another location within the bathtub. Tube 52 may be a short vertical section as shown in FIG. 4-5, or it may be a longer flexible tube or hose that can travel within the bathtub to dispense the water and ball 48 to other locations within the bathtub. For example, a plurality of sections of tubing 52 may be used to bring the ball 48 to any desired location within the bathtub.

Figure 6:
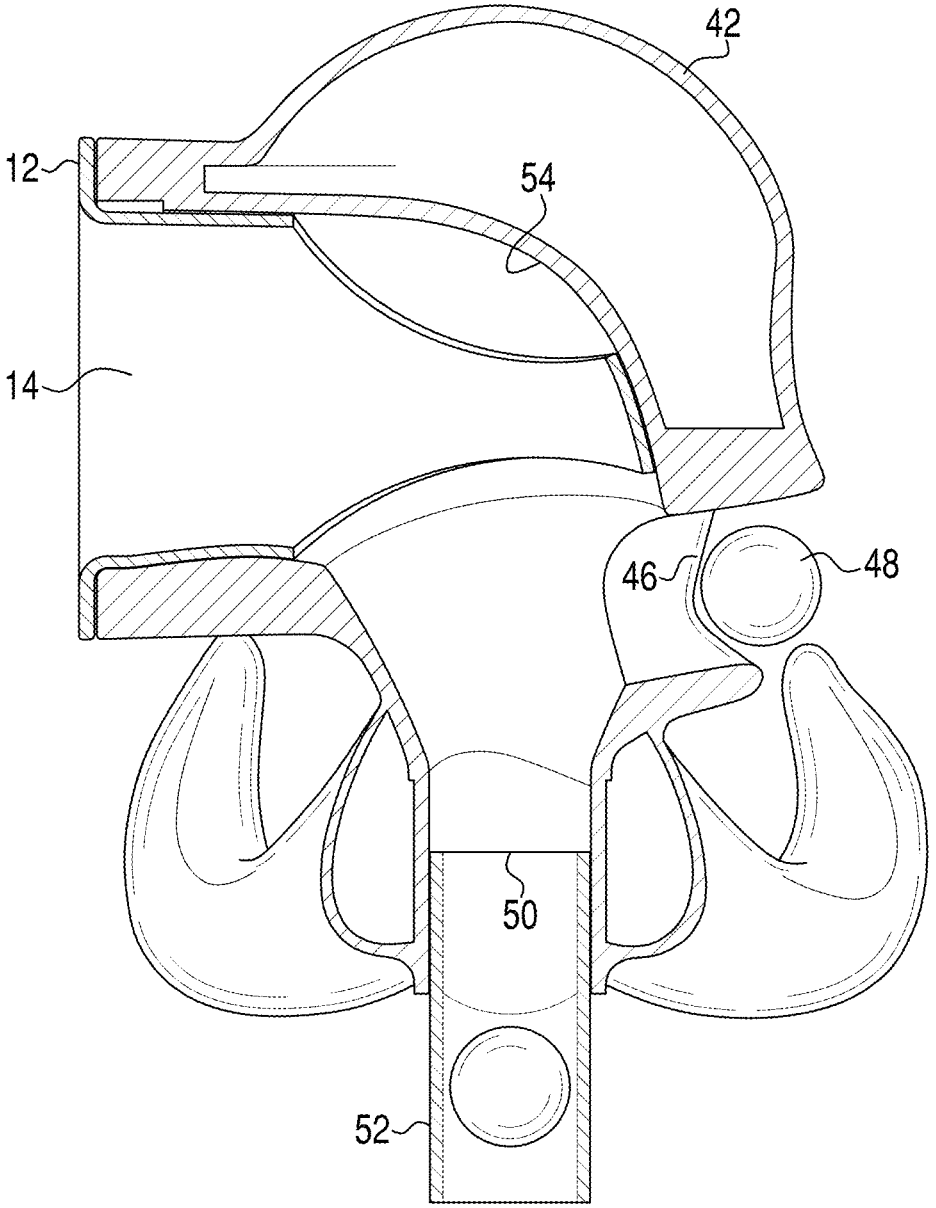
FIG. 6 depicts a side sectional view of the bathtub spout extension system of FIG. 4.

As shown in FIG. 6, the head portion 42 has an interior cavity 54 that is configured to receive bracket portion 14, which holds the head portion 42 against the wall plate 12. The interior cavity 54 also serves to distribute water from the bathtub spout downwardly into outlet 50 and tubing 52 as well as into the tentacles towards outlets 44. Upon insertion of ball 48 into inlet 46, the flow of water forces the ball 48 downwardly through the head portion 42 out the outlet 50 and into the tubing 52.

Devices 10, 40 disclosed herein may be configured to further reduce the noise ordinarily created by water flowing out of a bathtub spout. In many ordinary instances, the water flowing out of a bathtub spout may reach volume levels above 90 decibels, a range in which hearing damage may occur. The devices 10, 40 are configured to significantly reduce the volume level of the flowing water by construction of the head portions 18, 42. Head portions 18, 42 may be made of a resilient material, such as neoprene or a foam-based material, to dampen the noise of the flowing water.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended set of claims.

What is claimed is:

1. A system for distributing water from a bathtub spout protruding from a wall into a bathtub residing below the spout, the system comprising:

a wall plate mounted to the wall and surrounding but not contacting the bathtub spout, the wall plate having a bracket portion extending from the wall plate and away from the wall, the bracket portion enclosing but not contacting the bathtub spout;

a water diverting portion configured to fit over and attach to the bracket portion of the wall plate, the water diverting portion configured to receive water flowing out of the bathtub spout and to divert the water to an outlet;

the water diverting portion having an inlet for receiving a ball, the ball traveling within and through the water diverting portion and emitting from the outlet of the water diverting portion; and at least one tubular member fluidly connected to the outlet of the water diverting portion, the ball traveling within and through the at least one tubular member.

2. The system of claim 1 wherein the water diverting portion further includes at least one water outlet that permits water to flow outwardly from the water diverting portion, the at least one water outlet sized smaller than the ball.

3. The system of claim 2 wherein the water diverting portion has a plurality of water outlets to create a shower suitable for bathing, the plurality of water outlets each sized smaller than the ball.

4. The system of claim 1 wherein a first tubular member is fluidly connected to the outlet of the water diverting portion, and a second tubular member is fluidly connected to the first tubular member, the second tubular member terminating in an outlet through which both water and the ball may pass to enter the bathtub.

5. The system of claim 4 wherein the first tubular member travels vertically downwardly and the second tubular member extends outwardly towards the center of the bathtub.

6. The system of claim 1 wherein a first tubular member is fluidly connected to the outlet of the water diverting portion and a plurality of other tubular members are fluidly connected to the first tubular member, the ball passing through the plurality of tubular members to enter the bathtub.

7. The system of claim 1 wherein the water diverting portion resembles an animal.

8. The system of claim 1 wherein the water diverting portion resembles a character.

9. The system of claim 1 wherein the water diverting portion resembles an octopus.

10. The system of claim 9 wherein the water diverting portion further includes at least one tentacle having a water outlet that permits water to flow outwardly from the water diverting portion, the at least one water outlet sized smaller than the ball.

* * * * *